United States Patent [19]

Davis

[11] 4,076,632

[45] Feb. 28, 1978

[54] FABRIC SOFTENER

[75] Inventor: James E. Davis, Cincinnati, Ohio

[73] Assignee: The Procter & Gamble Company, Cincinnati, Ohio

[21] Appl. No.: 770,487

[22] Filed: Feb. 22, 1977

[51] Int. Cl.[2] ..... D06M 13/34; D06M 13/40; D06M 13/46

[52] U.S. Cl. ..... 252/8.8

[58] Field of Search ..... 252/8.8

[56] References Cited

U.S. PATENT DOCUMENTS

| | | | |
|---|---|---|---|
| 3,729,416 | 4/1973 | Brüning et al. | 252/8.8 |
| 3,756,950 | 9/1973 | Gluck | 252/8.75 |
| 3,850,818 | 11/1974 | Katsumi et al. | 252/8.8 |
| 3,879,300 | 4/1975 | Renold | 252/8.8 |
| 3,904,533 | 9/1975 | Neiditch et al. | 252/8.8 |
| 3,954,634 | 5/1976 | Monson et al. | 252/8.8 |

FOREIGN PATENT DOCUMENTS

| | | | |
|---|---|---|---|
| 4,215,596 | 8/1967 | Japan | 252/8.8 |

*Primary Examiner*—John Kight, III
*Attorney, Agent, or Firm*—William H. Gould; Richard C. Witte; Thomas H. O'Flaherty

[57] ABSTRACT

Liquid fabric conditioning compositions having good physical stability are provided by mixtures of a cationic fabric conditioning agent, protonated di-poly-ethoxy monoalkyl amine, urea and water.

13 Claims, No Drawings

FABRIC SOFTENER

BACKGROUND OF THE INVENTION

This invention relates to compositions and methods for conditioning fabrics during the rinse cycle of home laundering operations. This is a widely used practice to impart to laundered fabrics a texture or handle that is smooth, pliable and fluffy to the touch (i.e. soft) and also to impart to the fabrics a reduced tendency to pick up and/or retain an electrostatic charge (i.e. static control), especially when the fabrics are dried in an automatic dryer.

It has become commonplace today for homemakers to use fabric conditioning compositions comprising major amounts of water, lesser amounts of fabric conditioning agents, and minor amounts of optional ingredients such as perfumes, colorants, preservatives and stabilizers. Such compositions are aqueous suspensions or emulsions which can be conveniently added to the rinsing bath of home laundry operations.

Many compounds have been disclosed as having the capacity to condition fabrics. One common class is cationic in nature. A representative disclosure of cationic fabric conditioning agents appears in column 2 of U.S. Pat. No. 3,756,950 issued to Gluck on Sept. 4, 1973. The use of alkyl amido imidazolinium salts as fabric conditioning agents in liquid compositions is disclosed in U.S. Pat. No. 3,904,533 issued to Neiditch on Sept. 9, 1975. The use of polyamido quaternized biurets as cationic fabric conditioners is disclosed by Okamato et al, Japanese patent publication 42-15596 published Aug. 28, 1967. The foregoing Gluck, Neiditch and Okamato reference are herein incorporated by reference.

A number of prior art compositions, both as disclosed in the literature and as sold commercially, contain minor amounts of solvents to improve stability and/or control viscosity. For example, U.S. Pat. Nos. 3,954,634 granted on May 4, 1976 to Monson et al and 3,729,416 granted on Apr. 24, 1973 to Brüning et al, the latter mentioning alkanols, alkanediols, alkoxyalkane diols, and alkanones.

Katsumi et al, U.S. Pat. No. 3,850,818 issued Nov. 26, 1974 discloses certain ethoxylated quaternary salts as fabric conditioning agents, admixed in specified proportions with conventional quaternaries and with one or more of the following additives: $C_{1-3}$ alcohols, glycols, glycerol, sorbitol and urea. Katsumi's ethoxylated quaternaries have the structure $$\left[ H(OCH_2CH_2)_m-\overset{\overset{R_1}{|}}{\underset{\underset{R_2}{|}}{N}}-(CH_2CH_2O)_nH \right]^+ X^-$$

where $R_1$ is long chain alkyl; $R_2$ is benzyl or an alkyl group having from 1 to 3 carbon atoms; the sum $(m + n)$ is from 20 to 100; and X is Cl, Br or $C_2H_5SO_4$.

Renold, U.S. Pat. No. 3,879,300 issued Apr. 22, 1975 discloses as a fabric softener the compound N-higher alkyl-1,3 propylene diamine, and formulates it into compositions containing urea or sugar as an additive to improve softening or color. Glycols and alcohols may also be used.

Another means that has been suggested for the preparation of physically stable liquid fabric conditioning compositions is homogenization, as for example by Monson et al in U.S. Pat. No. 3,729,416 cited hereinbefore.

Among the objects of the present invention are the preparation of physically stable compositions providing good fabric softening and fabric antistatic properties, produced economically without the need for homogenization, and formulated from relatively low cost and commercially available raw materials without the need for expensive and potentially hazardous solvents.

SUMMARY OF THE INVENTION

The present invention relates to fabric conditioning compositions in liquid form for use in home laundry operations. These compositions comprise four essential components: (a) from about 3% to about 12%, preferably from about 4% to about 8%, of a cationic fabric conditioning agent; (b) from about 0.2% to about 1.3% of protonated di-polyethoxy monoalkyl amine, (c) from about 1% to about 6%, preferably from about 2% to about 5%, of urea; and (d) the balance chiefly water. The weight ratio of urea to protonated di-polyethoxy monoalkylamine is from about 18:1 to about 3:1, preferably from about 18:1 to about 4.5:1. Minor amounts of other materials often used in liquid fabric conditioners can also be present, such as colorants, perfumes, preservatives, and optical brighteners. In the foregoing recitation, all percentages are by weight based on the complete fabric conditioning composition.

In its method aspect, this invention provides a process of treating fabrics with the compositions defined above.

DETAILS OF THE INVENTION

The compositions of the present invention contain, as component (a), cationic fabric conditioning agents. These cationic agents are known fabric softener and fabric antistatic agents. A single cationic fabric conditioning agent can be used, or a mixture of two or more cationic fabric conditioning agents can be used together in the practice of this invention.

The amount of fabric conditioning agents in the compositions of this invention is from about 3% to about 12%, preferably from about 4% to about 8%, by weight of the composition. The lower limits are amounts needed to contribute effective fabric conditioning performance when added to laundry rinse baths in the manner which is customary in home laundry practice. The upper limits are amounts beyond which physical instability problems arise in connection with storage of the liquid compositions. It will be appreciated that the conditions of storage greatly affect stability, and the formulator of fabric conditioning compositions with ordinary skill in the art can readily determine compositions having sufficient physical stability for his particular climate and warehouse storage conditions.

The fabric antistat/softener conditioners of this invention are those water insoluble or water dispersible cationic organic materials which are generally employed as conventional fabric conditioning agents during the rinsing cycle of the household laundering process. They are organic, waxy materials having a melting (or softening) point between 25° C and 115° C. Such materials possess both fabric softening and fabric antistat properties.

Generally, the cationic nitrogen-containing compounds such as quaternary ammonium compounds and amines have one or two straight-chain organic groups of at least eight carbon atoms. Preferably, they have one or two such groups of from 12 to 22 carbon atoms. Preferred cation-active softener compounds include the quaternary ammonium antistat/softener compounds corresponding to the formula

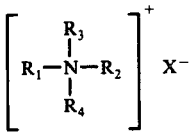

wherein $R_1$ is hydrogen or an aliphatic group having from 1 to 22 carbon atoms; $R_2$ is an aliphatic group having from 10 to 22 carbon atoms; $R_3$ and $R_4$ are each alkyl groups having from 1 to 3 carbon atoms; and X is an anion selected from the halogen, acetate, phosphate, nitrate and methylsulfate radicals.

Representative examples of quaternary softeners of the invention include tallow trimethyl ammonium chloride; ditallow dimethyl ammonium chloride; ditallow dimethyl ammonium methyl sulfate; dihexadecyl dimethyl ammonium chloride; di(hydrogenated tallow) dimethyl ammonium chloride; dioctadecyl dimethyl ammonium chloride; dieicosyl dimethyl ammonium chloride; didocosyl dimethyl ammonium chloride; di(hydrogenated tallow) dimethyl ammonium methyl sulfate; dihexadecyl diethyl ammonium chloride; dihexadecyl dimethyl ammonium acetate; ditallow dipropyl ammonium phosphate; ditallow dimethyl ammonium nitrate; and di(coconut-alkyl) dimethyl ammonium chloride.

An especially preferred quaternary ammonium fabric conditioning agent is ditallow dimethyl ammonium chloride that is commercially available from General Mills, Inc. under the tradename ALIQUAT-2HT and from Ashland Oil, Inc. as ADOGEN 448.

Other suitable cation-active softener/antistat compounds herein are the quaternary imidazolinium salts. Preferred salts are those conforming to the formula:

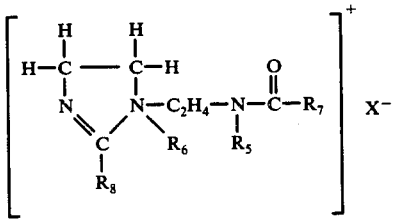

wherein $R_6$ is an alkyl group having from 1 to 4, preferably from 1 to 2 carbon atoms, $R_5$ is an alkyl group having from 1 to 4 carbon atoms or a hydrogen radical, $R_8$ is an alkyl group having from 1 to 22, preferably at least 15 carbon atoms or a hydrogen radical, $R_7$ is an alkyl group having from 8 to 22, preferably at least 15 carbon atoms, and X is an anion, preferably methylsulfate or chloride ions. Other suitable anions include those disclosed with reference to the cationic quaternary ammonium fabric antistat/softeners described hereinbefore. Particularly preferred are those imidazolinium compounds in which both $R_7$ and $R_8$ are alkyl groups having from 12 to 22 carbon atoms, e.g., 1-methyl-1-[(stearoylamide)ethyl]-2-heptadecyl-4,5-dihydroimidazolinium methylsulfate and 1-methyl-1-[(palmitoylamide)ethyl]-2-octadecyl-4,5-dihydroimidazolinium chloride.

An especially preferred quaternary imidazolinium fabric conditioning agent is 2-tallow-1-methyl-1-(tallowamidoethyl) imidazoline methylsulfate having the structure:

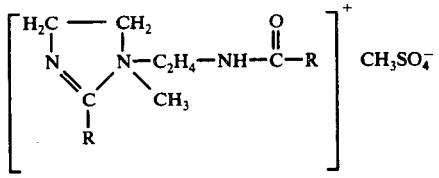

where R is an alkyl group derived from tallow. This material is commercially available from the Ashland Oil Co. under the trade name VARISOFT-445.

Other suitable cation-active antistat/softener compounds herein are polyamido quaternized biurets having the following formula:

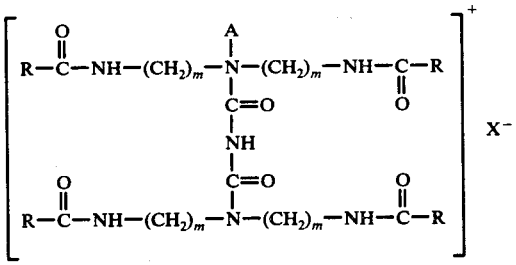

wherein R is an aliphatic hydrocarbyl group (saturated or unsaturated), a substituted aliphatic hydrocarbyl group, or an alkoxylated aliphatic hydrocarbyl group having from about 10 to 30 carbon atoms. Preferably, the number of carbon atoms is from about 12 to 22 with R being an aliphatic hydrocarbyl group. Most preferably, R is derived from fatty acids, particularly from tallow fatty acid, which acid has predominately 16 to 18 carbon atoms.

A is a vicinal dihydroxy alkyl group containing at least 3 carbon atoms, preferably from 3 to about 8 carbon atoms; especially preferred is the 2,3- dihydroxy propyl group. Values of *m* range from 1 to about 8, preferably 2 or 3. X is an anion selected from the halogen, acetate, phosphate, nitrate and methylsulfate radicals.

Materials fitting the above-given formula where A is 2,3-dihydroxy propyl, R is an alkyl group derived from tallow, *m* is 2, and X is Cl, and containing minor amounts of starting materials and other reaction products, are sold under the name TAFLON-320A by Daiichi Kogyo Seiyaku Co., Ltd. of Japan. The manufacture of such materials is described in Okamoto's Japanese Patent Publication 42-15596 referred to hereinbefore. It will be appreciated that the epoxy groups mentioned in Okamoto predominantly hydrolyze to vicinal hydroxyl groups as shown in the foregoing structural formula at the pH of the fabric softening compositions which is from about 5 to about 7.

Other cationic quaternary ammonium fabric antistat/softeners which are useful herein include, for example, alkyl ($C_{12}$ to $C_{22}$)-pyridinium chlorides, alkyl ($C_{12}$ to $C_{22}$)-alkyl ($C_1$ to $C_3$)-morpholinium chlorides, and quaternary derivatives of amino acids and amino esters.

Component (b) of this invention is protonated dipolyethoxy monoalkyl amine:

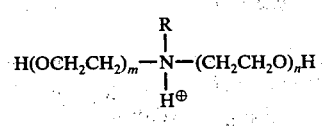

R is an alkyl group, preferably having from about 10 to about 20 carbon atoms, most preferably from about 14 to about 18 carbon atoms; and the sum $(m + n)$ is preferably from about 10 to about 40, most preferably from about 16 to about 30, where $m$ and $n$ are each integers greater than 1.

The amount of protonated di-polyethoxy monoalkyl amine in the compositions of this invention is from about 0.2% to about 1.3% by weight of the composition. Incorporation of said protonated amine is ordinarily accomplished by adding the corresponding free, unprotonated amine to the remainder of the composition which is acidic in nature. The final composition ordinarily has a pH from about 5 to about 7, and at such pH's the amine is predominantly in protonated form.

Di-polyethoxy monoalkyl amine is made by ethoxylating monoalkyl amine in a conventional manner. An especially preferred amine has an alkyl group derived from tallow and the sum $(m + n)$ is equal to 23. This amine is commercially available from Daiichi Kogyo Seiyaku Co., Ltd. of Japan under the trade name AMILADIN-D. It has been used in liquid fabric conditioning compositions of the prior art as a wetting agent, as for example the Example 4R composition defined hereinbelow. This amine is to be distinguished in both structure and utility from the ethoxylated quaternary salt disclosed as a fabric softener by Katsumi et al in U.S. Pat. No. 3,850,818 mentioned hereinbefore.

Component (c) of this invention is urea, which is used in amounts from about 1% to about 6%, preferably from about 2% to about 5%, by weight of the composition.

Components (b) and (c), used in suitable amounts and proportions, provide the good properties of physical stability that characterize the liquid fabric conditioning compositions of this invention. Suitable weight ratios of urea to protonated di-polyethoxy monoalkylamine are from about 18:1 to about 3:1, and preferred ratios are from about 18:1 to about 4.5:1. Use of components (b) and (c), in an aqueous medium in conjunction with component (a), makes possible the formulation of fabric conditioning compositions having satisfactory physical stability without the need for conventional solvents such as alcohols (e.g. ethanol), glycols (e.g. ethylene glycol), or glycol ethers (e.g. diethylene glycol monoethylether). Removal of these solvents in fact means reduced costs and greater product safety as well as improved physical stability.

By physical stability herein is meant the ability of a composition to maintain a homogeneous condition for long periods of storage. In commercial practice, such storage may be at various temperatures that hold approximately constant both above and below the normal ambient, and also at various cycling temperatures including those below the freezing point. Hence laboratory testing typically attempts to reproduce each of the above as described immediately preceding Example 5R hereinafter.

In addition to components (a), (b) and (c) as hereinbefore defined, the balance of the compositions of this invention is chiefly comprised of component (d), water. Water is the medium in which the essential components (a), (b) and (c), and the optional components, are dissolved, suspended or dispersed. Since minerals or other impurities in the water can react with certain of the other essential or optional composition components, it may be preferable to utilize deionized or soft water in the compositions herein. Optional components of the liquid fabric conditioning compositions of this invention are conventional in nature, and generally comprise from about 0.1% to about 10% by weight of the composition. Such optional components include, but are not limited to, colorants, perfumes, preservatives, optical brighteners, opacifiers, pH buffers, viscosity modifiers, fabric conditioning agents in solid form such as clay, emulsifiers, stabilizers, shrinkage controllers, spotting agents, germicides, fungicides, anti-corrosion agents, etc.

Although as hereinbefore described, solvents such as alcohols, glycols and glycol ethers are not necessary to the practice of this invention, it is contemplated that minor amounts thereof may be employed, provided the compositions contain the essential amounts and ratios of urea and protonated diethoxylated monoalkyl amine as hereinbefore defined. Ordinarily used in amounts up to about 5%, these solvents may be selected by a formulator of fabric conditioners to control, for example, viscosity of the composition, wetting out of the fabrics to be conditioned, or possibly to further influence product stability.

The liquid fabric conditioning compositions of the present invention can be prepared by conventional methods. Homogenizing is not necessary. A convenient and satisfactory method is to mix all essential components together batchwise at about 60–65° C., using a marine propeller for agitation. It is preferred to dilute the quaternary softeners with water before adding to the remainder of the composition. Temperature-sensitive optional components can be added after the fabric conditioning composition is cooled to room temperature or thereabouts.

The liquid fabric conditioning compositions of this invention are used by adding to the rinse cycle of conventional home laundry operations. Generally, rinse water has a temperature of from about 5° C. to about 60° C. The concentration of the cationic fabric conditioners of this invention is generally from about 2 ppm to about 200 ppm, preferably from about 10 ppm to about 100 ppm, by weight of the aqueous rinsing bath.

In general, the present invention in its fabric conditioning method aspect comprises (a) washing fabrics in a conventional washing machine with a detergent composition; (b) rinsing the fabrics; (c) adding during the rinsing stage of the operation the above-described amounts of cationic fabric conditioners in an aqueous liquid composition containing specified amounts and ratios of protonated di-polyethoxymonoalkyl amine and urea as hereinbefore defined; and (d) drying the fabrics.

The detergent composition normally contains an anionic, nonionic, amphoteric or ampholytic surfactant or a mixture thereof, and frequently contains in addition an organic or inorganic builder. When multiple rinses are used, the fabric conditioning composition is preferably added to the final rinse. Fabric drying can take place either in the open air or in an automatic dryer.

The following examples illustrate the aqueous liquid fabric conditioning compositions and methods of this invention and the benefits achieved by the utilization of such compositions and methods. These examples are illustrative of the invention herein and are to be construed as limiting thereof.

EXAMPLE 1

The liquid fabric conditioning composition of Example 1 was prepared according to the following procedure:

Two premixes were prepared, the first comprised of 10.0 grams of water mixed with 13.1 grams of Aliquat-2HT, a 75% aqueous solution of ditallow dimethyl ammonium chloride; and the second comprised of 18.0 grams of water mixed with 29.5 grams of Taflon-320A, a 19% active aqueous solution of polyamido quaternized biuret.

The liquid fabric conditioning composition was prepared by adding together, during continuous agitation by a marine propeller at about 65° C., the following materials in sequence: 170 grams of water; 0.66 grams of a 25% aqueous solution of glutaraldehyde; 4.4 grams of Amiladin-D, a 30% aqueous solution of dipolyethoxy monoalkylamine; the two premixes prepared as described hereinbefore; and 12.0 grams of granular urea. Agitation was continued while the batch was allowed to cool to 20° C. After cooling, agitation was continued during the addition of 0.75 grams of a 1% solution of dye; 0.45 grams of perfume; and enough water to make a 300-gram batch of liquid fabric conditioner.

The composition of Example 1 had a pH of 5.7. When tested for fabric softening on cotton terry cloths and T-shirts this composition was determined to be substantially as effective as the composition of Example 4R described hereinafter.

EXAMPLES 2, 3R AND 4R

The compositions of Examples 2, 3R and 4R were prepared in a manner similar to that of Example 1 except for the differences in composition as shown in Table I. All 3 compositions are effective fabric conditioners.

The "R" designation of Examples 3R and 4R signifies that these are Reference examples and are not within the scope of the instant invention.

The compositions of Examples 1, 2, 3R and 4R are given in detail on Table I. Also given thereon are data describing the freeze-thaw characteristics of these 4 compositions when tested side by side in the laboratory. It is readily apparent that superior freeze-thaw characteristics are exhibited by Examples 1 and 2 which are representative of this invention, in comparison with those of Examples 3R and 4R which are not.

Table I

| Example No. | 1 | 2 | 3R | 4R |
|---|---|---|---|---|
| Composition (Wt.%) | | | | |
| Ditallow dimethyl ammonium chloride[a] | 3.27 | | 3.27 | 3.27 |
| Polyamido quaternized buiret[b] | 1.86 | 1.86 | 1.86 | 1.85 |
| 2-tallow-1-methyl-1-(tallow-amidoethyl) imidazoline methylsulfate[c] | — | 3.27 | — | — |
| Protonated di-poly-ethoxy monoalkyl amine[d] | 0.44 | 0.44 | — | 0.85 |
| Urea | 4.00 | 4.00 | 4.00 | — |
| Isopropanol | — | — | — | 1.09 |
| Ethylene Glycol | — | — | — | 1.75 |
| Colorant | 0.0025 | 0.0025 | 0.0025 | 0.0025 |
| Perfume | 0.15 | 0.15 | 0.15 | 0.05 |
| Preservative | 0.055 | 0.055 | 0.055 | 0.0005 |
| Sodium Acetate | — | — | — | 0.01 |
| Water | balance | balance | balance | balance |
| Freeze-Thaw Stability | | | | |
| Cycle 1 - Freeze: | Frozen at 0° F | | Frozen at 0° F | Frozen at 0° F |
| - Thaw: | Recovers upon thawing | | Recovers upon thawing | Recovers upon thawing |
| Cycle 2 - Freeze: | Frozen at 0° F | | Frozen at 0° F | Frozen at 0° F |
| - Thaw: | Recovers upon thawing | | Products remained gelled when returned to 70° F. Thick lumpy gell after shaking. | Product remained gelled after returning to 70° F. Shaking does not break up gell. |
| Cycle 3 - Freeze: | Frozen at 0° F | | Frozen at 0° F | Test stopped after Cycle 2 |
| - Thaw: | Product is thick but pourable when returns to 70° F. | | Product remained gelled when returned to 70° F. Thick gell after shaking. | |
| Cycle 4 - Freeze: | Frozen at 0° F | | Test stopped after Cycle 3 | |
| Thaw: | Product is viscous but pourable when returns to 70° F. | | | |

Notes to Table I
R = reference composition
[a]Aliquat-2HT active
[b]Taflon-320A active
[c]Varisoft-445 active
[d]protonated Amiladin-D active The composition of Example 1 of this invention was also stored under a variety of other conditions and found to have physical stability equal to or better than that of the composition of Reference Example 4R. Eight separate samples of each composition were tested as described below:

| | |
|---|---|
| Temperature cycling. Four complete cycles, alternating 24 hours each at the high and at the low temperatures: | |
| (i) | 0° F. to 70° F. |
| (ii) | 30° F. to 50° F. |
| (iii) | 50° F. to 100° F. |
| Storage at constant temperatures: | |
| (iv) | 1 month at 30° F. |
| (v) | 1 month at 40° F. |
| (vi) | 1 month at 70° F. |
| (vii) | 1 month at 100° F. |
| (viii) | 10 days at 120° F. |

EXAMPLE 5R

A composition identical to that of Example 4R, except containing 0.44% instead of 0.85% protonated dipolyethoxy monoalkyl amine, has been commercially manufactured and sold by Procter & Gamble Sunhome Co., Ltd., Osaka, Japan under the tradename MONOGEN SOFTER. It is an effective fabric conditioner. It is a Reference Example and not within the scope of this invention. Its freeze-thaw characteristics were determined to be less stable than those of the Example 4R composition described on Table I.

EXAMPLE 6

A composition was prepared similar to that of Example 1 except that it contained 1.0% urea and 4.0% ethylene glycol. It is within the scope of this invention. Fabric conditioning effectiveness and physical stability were good. Blends in any proportion of the compositions of Examples 1 and 6 have good fabric conditioning effectiveness and good physical stability.

EXAMPLES 7–12

The compositions of Examples 7–12 are prepared in a manner similar to that of Example 1 except for the differences in composition as shown in Table II. They are within the scope of this invention. Fabric conditioning effectiveness and physical stability are good.

Table II

| Example No. | 7 | 8 | 9 | 10 | 11 | 12 |
|---|---|---|---|---|---|---|
| Composition (Wt.%) | | | | | | |
| Cationic fabric conditioner | 3 A | 4 E | 6 C | 3 B | 12 D | 10 F |
| Protonated di-polyethoxy monoalkyl amine | 0.6 K | 0.2 H | 1.3 G | 0.33 J | 1.1 K | 0.33 G |
| Urea | 2 | 3.6 | 5 | 1 | 6 | 4 |
| Water | balance | balance | balance | balance | balance | balance |

Notes to Table II

A Tallow trimethyl ammonium chloride.

B Ditallow dipropyl ammonium phosphate.

C 1-methyl-1-[(stearoylamide) ethyl]-2-heptadecyl-4,5-dihydroimidazolinium methylsulfate.

D 1-methyl-1-(palmitoylamide) ethyl]-2-octadecyl-4,5-dihydroimidazolinium chloride.

E Polyamido quaternized biuret where R is an alkyl group derived from coconut oil; A is 1, 2-dihydroxy ethyl; m = 1; x = acetate.

F Polyamido quaternized biuret where R is an alkyl group having 20 carbon atoms; A is 4,5-dihydroxy hexyl; m = 5; x = phosphate.

G R is an alkyl group having 10 carbon atoms, and the sum (m + n) equals 16.

H R is an alkyl group having 20 carbon atoms, and the sum (m + n) equals 30.

J R is an alkyl group having 14 carbon atoms, and the sum (m + n) equals 10.

K R is an alkyl group derived from tallow, and the sum (m + n) equals 40.

What is claimed:

1. A liquid fabric conditioning composition comprising:
   (a) from about 3% to about 12% by weight of the composition of cationic fabric conditioning agents;
   (b) from about 0.2% to about 1.3% by weight of the composition of protonated di-polyethoxy monoalkyl amine;
   (c) from about 1% to about 6% by weight of the composition of urea; and
   (d) water; wherein the weight ratio of urea to protonated di-polyethoxy monoalkyl amine is from about 18:1 to about 3:1.

2. The fabric conditioning composition of claim 1 wherein the cationic fabric conditioning agent is from about 4% to about 8% by weight of the composition and is selected from the group consisting of quaternary ammonium salts, quaternary imidazolinium salts, polyamido quaternized biurets, alkyl pyridinium chlorides, alkyl morpholinium chlorides, and quaternary derivatives of amino acids and amino esters.

3. The fabric conditioning composition of claim 1 wherein the protonated di-polyethoxy monoalkyl amine has the structural formula

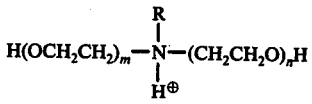

where R is an alkyl group having from about 10 to about 20 carbon atoms and where $(m + n)$ is from about 10 to about 40.

4. The fabric conditioning composition of claim 3 wherein the urea is from about 2% to about 5% by weight of the composition and wherein the weight ratio of urea to di-polyethoxy monoalkyl amine is from about 18:1 to about 4.5:1.

5. The fabric conditioning composition of claim 4 wherein, in relation to the structural formula of said protonated di-polyethoxy monoalkyl amine, R is an alkyl group derived from tallow and $(m + n)$ is equal to 23.

6. The fabric conditioning composition of claim 4 having a pH from about 5 to about 7.

7. The fabric conditioning composition of claim 4 wherein the cationic fabric conditioning agent is from about 4% to about 8% by weight of the composition and is selected from the group consisting of quaternary ammonium salts, quaternary imidazolinium salts, polyamido quaternized biurets, alkyl pyridinium chlorides, alkyl morpholinium chlorides, and quaternary derivatives of amino acids and amino esters.

8. The fabric conditioning composition of claim 4 wherein the cationic fabric conditioning agent is from about 4% to about 8% by weight of the composition and is selected from the group consisting of ditallow dimethyl ammonium chloride, 2-tallow-1-methyl-1-(tallow-amidoethyl) imidazoline methylsulfate, and polyamido quaternized biuret having the formula

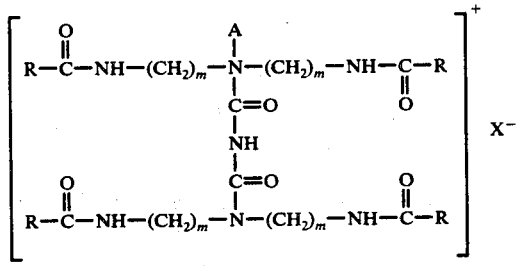

where A is 2, 3-dihydroxy propyl, R is an alkyl group derived from tallow, $m$ is 2 and X is Cl.

9. The fabric conditioning composition of claim 8 having a pH from about 5 to about 7 and wherein, in relation to the structural formula of said protonated di-polyethoxy monoalkyl amine, R is an alkyl group derived from tallow and $(m + n)$ is equal to 23.

10. A method for conditioning fabrics comprising the steps of:

(a) washing the fabrics;

(b) rinsing the fabrics in an aqueous bath containing the composition of claim 1 in an amount sufficient to provide a concentration of cationic fabric conditioner of about 2 ppm to about 200 ppm by weight of the rinsing bath; and (c) drying the fabrics.

11. A method for conditioning fabrics comprising the steps of:

(a) washing the fabrics;

(b) rinsing the fabrics in an aqueous bath containing the composition of claim 4 in an amount sufficient to provide a concentration of cationic fabric conditioner of about 2 ppm to about 200 ppm by weight of the rinsing bath; and (c) drying the fabrics.

12. A method for conditioning fabrics comprising the steps of:

(a) washing the fabrics;

(b) rinsing the fabrics in an aqueous bath containing the composition of claim 8 in an amount sufficient to provide a concentration of cationic fabric conditioner of about 10 ppm to about 100 ppm by weight of the rinsing bath; and (c) drying the fabrics.

13. A method for conditioning fabrics comprising the steps of:

(a) washing the fabrics;

(b) rinsing the fabrics in an aqueous bath containing the composition of claim 9 in an amount sufficient to provide a concentration of cationic fabric conditioner of about 10 ppm to about 100 ppm by weight of the rinsing bath; and (c) drying the fabrics.

* * * * *